US008397960B1

(12) United States Patent
Farrar, Jr.

(10) Patent No.: US 8,397,960 B1
(45) Date of Patent: Mar. 19, 2013

(54) DISPENSING AND SEALING ASSEMBLY FOR CONTAINER

(76) Inventor: Woodrow Wilson Farrar, Jr., Lillie, LA (US)

( * ) Notice: Subject to any disclaimer, the term of this patent is extended or adjusted under 35 U.S.C. 154(b) by 539 days.

(21) Appl. No.: 12/653,577

(22) Filed: Dec. 16, 2009

(51) Int. Cl.
*B65D 5/72* (2006.01)
*B65D 25/40* (2006.01)
*B65D 35/38* (2006.01)
*B65D 45/00* (2006.01)

(52) U.S. Cl. ..... 222/567; 222/568; 222/570; 220/327

(58) Field of Classification Search ..... 222/566–568, 222/570, 465.1, 573; 220/327, 254.1; 215/11.4–11.6
See application file for complete search history.

(56) References Cited

U.S. PATENT DOCUMENTS

| | | | | | |
|---|---|---|---|---|---|
| 112,542 | A | * | 3/1871 | Capewell | 222/568 |
| 132,323 | A | * | 10/1872 | Robinson | 222/478 |
| 325,806 | A | * | 9/1885 | Abrahamson | 220/254.8 |
| 446,809 | A | * | 2/1891 | Bonbrake | 222/323 |
| 499,815 | A | * | 6/1893 | Williams | 210/285 |
| 573,273 | A | * | 12/1896 | Kellogg | 422/107 |
| 779,491 | A | * | 1/1905 | Hull | 238/241 |
| 1,370,665 | A | * | 3/1921 | Moore | 222/92 |
| 1,468,360 | A | | 1/1922 | Frey | |
| 1,438,899 | A | * | 12/1922 | Cassidy | 215/11.6 |
| 1,977,268 | A | * | 10/1934 | Endacott | 222/6 |
| 2,076,893 | A | * | 4/1937 | Johnson | 222/153.08 |
| 2,105,051 | A | * | 1/1938 | Myers | 222/153.05 |
| 2,320,084 | A | * | 5/1943 | Jundt | 222/86 |
| 2,576,889 | A | * | 11/1951 | Partain | 222/83.5 |
| 2,791,357 | A | | 5/1957 | Nelson | |
| 3,047,195 | A | | 7/1962 | Richmond | |
| 3,162,338 | A | * | 12/1964 | Grubelic | 222/484 |
| 3,253,728 | A | | 5/1966 | Putron | |
| 3,552,607 | A | | 1/1971 | Edwards et al. | 222/566 |
| 3,672,547 | A | * | 6/1972 | Kozlowski | 222/567 |
| 3,704,007 | A | | 11/1972 | Kroeger | 259/122 |
| 3,929,264 | A | | 12/1975 | Maynard, Jr. | 222/525 |
| 4,002,257 | A | * | 1/1977 | Hatridge | 222/568 |
| 4,129,236 | A | * | 12/1978 | Wrycraft et al. | 222/570 |
| 5,031,804 | A | | 7/1991 | Conrad | 222/566 |
| 5,092,498 | A | * | 3/1992 | Willems et al. | 222/526 |
| 5,104,013 | A | * | 4/1992 | Hawley | 222/566 |
| 5,501,357 | A | | 3/1996 | Fullin | 220/325 |
| 5,657,892 | A | | 8/1997 | Bolli et al. | 220/325 |
| 5,901,887 | A | * | 5/1999 | Wark | 222/568 |
| 6,315,147 | B1 | * | 11/2001 | Bachmeier | 220/325 |
| 6,575,333 | B1 | | 6/2003 | Raboin | 222/153.14 |
| 6,641,007 | B2 | | 11/2003 | Chung et al. | 222/529 |
| 6,863,098 | B2 | * | 3/2005 | Chrisco et al. | 141/286 |
| 8,127,963 | B2 | * | 3/2012 | Gerson et al. | 220/495.02 |
| 2007/0114202 | A1 | * | 5/2007 | Lee | 215/311 |

FOREIGN PATENT DOCUMENTS

DE 202005015173 U1 * 3/2006

* cited by examiner

*Primary Examiner* — Paul R Durand
*Assistant Examiner* — Matthew Lembo
(74) *Attorney, Agent, or Firm* — R. Keith Harrison

(57) ABSTRACT

A dispensing and sealing assembly for containers includes a mounting assembly comprising an assembly frame having an opening and a plurality of assembly mount flanges carried by the assembly frame. A dispensing assembly is carried by the mounting assembly and includes a tube skirt carried by the assembly frame generally over the opening and a dispensing assembly tube extending from the tube skirt.

9 Claims, 5 Drawing Sheets

DISPENSING AND SEALING ASSEMBLY FOR CONTAINER

FIELD

The disclosure generally relates to devices which facilitate dispensing of a fluid from a container. More particularly, the disclosure relates to a dispensing and sealing assembly which is suitable for attachment to a storage container to facilitate ease in dispensing of a fluid or pourable solid from the container and which effectively seals the container during storage of the container contents.

BACKGROUND

Some conventional storage containers which are used to store lubricating liquids or other fluids include a removable lid which may be fitted with a dispensing spout. A spout cap may normally be attached to the dispensing spout to seal the container during storage of the container contents. The spout cap can be selectively detached from the dispensing spout to facilitate pouring of the fluid from the container through the dispensing spout. However, removal of the spout cap from the dispensing spout may allow dirt, moisture and other impurities to enter the container. Moreover, even when the spout cap is attached to the dispensing spout, moisture can, over time, inadvertently enter the fluid in the container through the dispensing spout.

Therefore, a dispensing and sealing assembly which is suitable for attachment to a storage container to facilitate ease in dispensing a fluid or pourable solid from the container and which effectively seals the container during storage of the fluid is needed.

SUMMARY

The disclosure is generally directed to a dispensing and sealing assembly for containers. An illustrative embodiment of the dispensing and sealing assembly includes a mounting assembly including an assembly frame having an opening and a plurality of assembly mount flanges provided on the assembly frame for attachment to a container. A dispensing assembly is provided on the mounting assembly and includes a tube skirt provided on the assembly frame generally over the opening and a dispensing assembly tube extending from the tube skirt.

BRIEF DESCRIPTION OF THE DRAWINGS

The disclosure will now be made, by way of example, with reference to the accompanying drawings, in which.

DETAILED DESCRIPTION

Figure 1A:
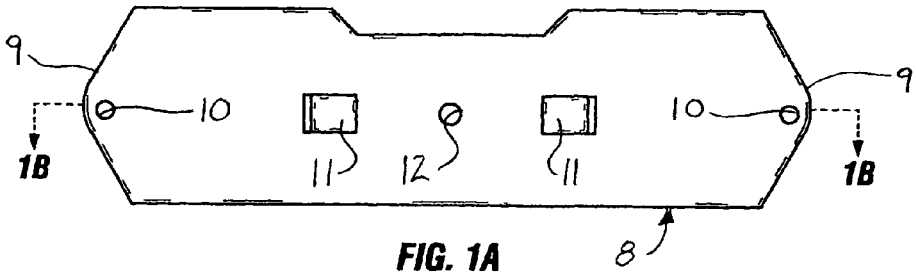
FIG. 1A is a top view of a mounting plate of an illustrative embodiment of the dispensing and sealing assembly for container.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description. As used herein, relative terms such as "upper" and "lower" are intended to be used in an illustrative and not a limiting sense. In some applications, therefore, those elements which are identified as "upper" may be located beneath those elements which are identified as "lower" in the following detailed description. Relative terms such as "top", "bottom", "upper", "lower" and "side" as used herein are to be construed as descriptive for purposes of understanding operation of the dispensing and sealing assembly as it is used in some exemplary applications and such relative terms may not apply in other applications. Therefore, such relative terms are not to be construed as limiting the scope of the appended claims.

Referring to the drawings, an illustrative embodiment of the dispensing and sealing assembly for container, hereinafter assembly, is generally indicated by reference numeral 1 in FIGS. 6 and 7A. As illustrated in FIG. 7A and will be hereinafter described, in an exemplary application the assembly 1 is attached to a container 36 (illustrated in phantom) which contains a supply of fluid or a pourable powdered, granulated or particulate solid (not illustrated). The container 36 may be a conventional cylindrical, plastic storage container which is commonly used to store commercially-available industrial lubricants (not illustrated), for example and without limitation. A container lid 38 (illustrated in phantom) may be detachably fitted on the container 36 to seal the interior of the container 36. A dispensing spout 39 (illustrated in phantom) may extend from the container lid 38 for selective dispensing of the contents (not illustrated) from the container 36 through the dispensing spout 39. In some embodiments, spout threads 40 may be provided on the interior surface of the dispensing spout 39, as illustrated in FIG. 7B. In other embodiments, the spout threads 40 may be provided on the exterior surface of the dispensing spout 39. The container lid 38 may conventionally include a removable spout cap (not illustrated) which is normally seated in the dispensing spout 39 to seal the fluid contents of the container 36 for storage of the contents. An annular container groove 37 may circumscribe the exterior surface of the container 36 generally beneath the container lid 38. As will be hereinafter described, the assembly 1 can be used to selectively dispense the container contents from the container 36 through the dispensing spout 39 and also to seal the container 36 as the contents are stored in the container 36. The assembly 1 may prevent or at least minimize influx of dirt, moisture and other impurities into the container 36 both during the process of dispensing the contents from the container 36 and as the contents are stored in the container 36.

As further illustrated in FIGS. 6 and 7A, the assembly 1 may include a mounting assembly 2 which is adapted for attachment to the container 36 and a dispensing assembly 22 which is adapted for attachment to the mounting assembly 2 such as in a manner which will be hereinafter described. The dispensing assembly 22 is adapted to selectively dispense fluid or pourable solid contents (not illustrated) from the container 36 by gravity as the contents are poured from the container 36 through the dispensing spout 39. The dispensing assembly 22 may also be adapted to substantially seal the container 36 from dirt, moisture and other impurities during storage of the contents in the container 36.

Figure 2:
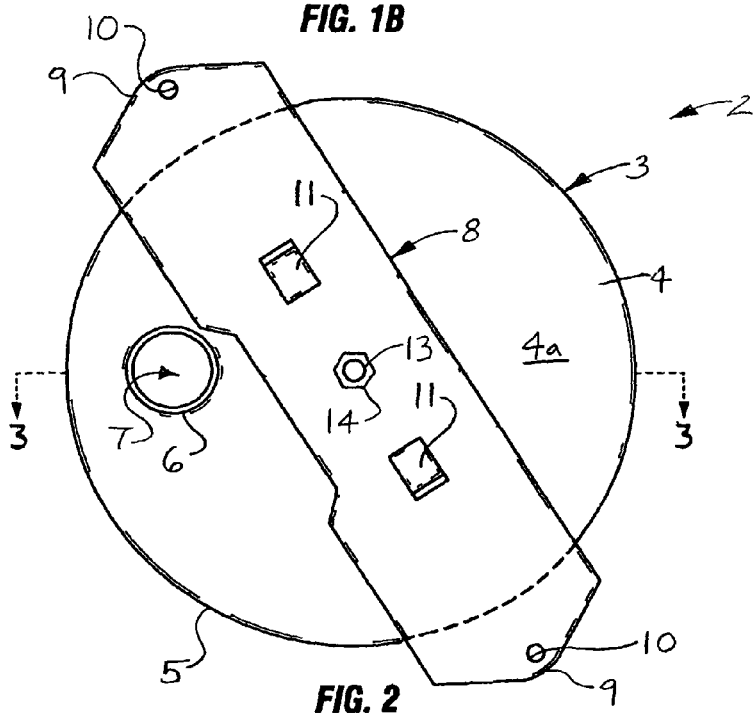
FIG. 2 is a top view of the assembly frame and mounting plate elements of an illustrative embodiment of the dispensing and sealing assembly for container.
Figure 3:
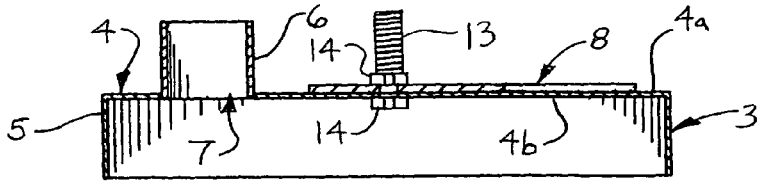
FIG. 3 is a sectional view, taken along section lines 3-3 in FIG. 2, of the assembly frame and mounting plate.
Figure 6:
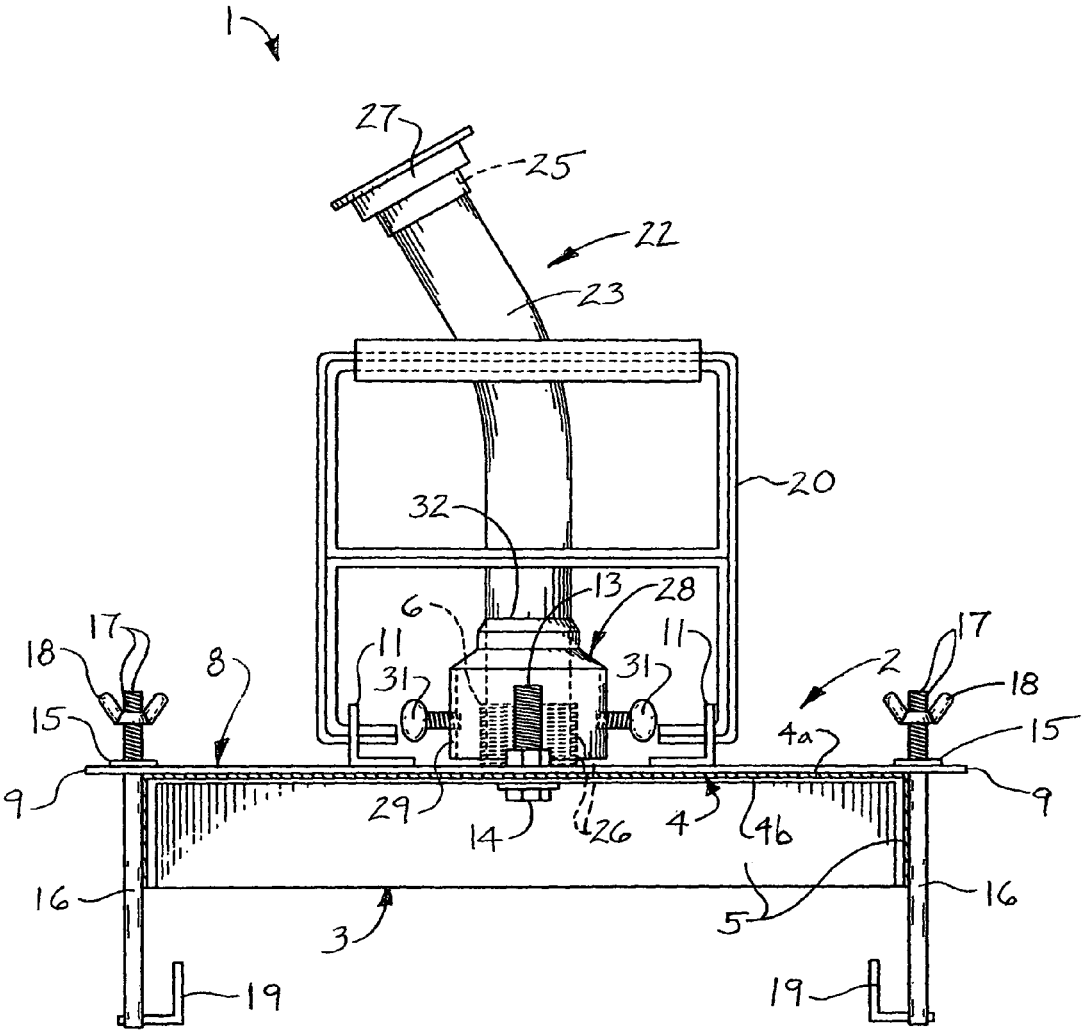
FIG. 6 is a front view of an illustrative embodiment of the dispensing and sealing assembly for container, with the assembly frame illustrated in sectional view.
Figure 7A:
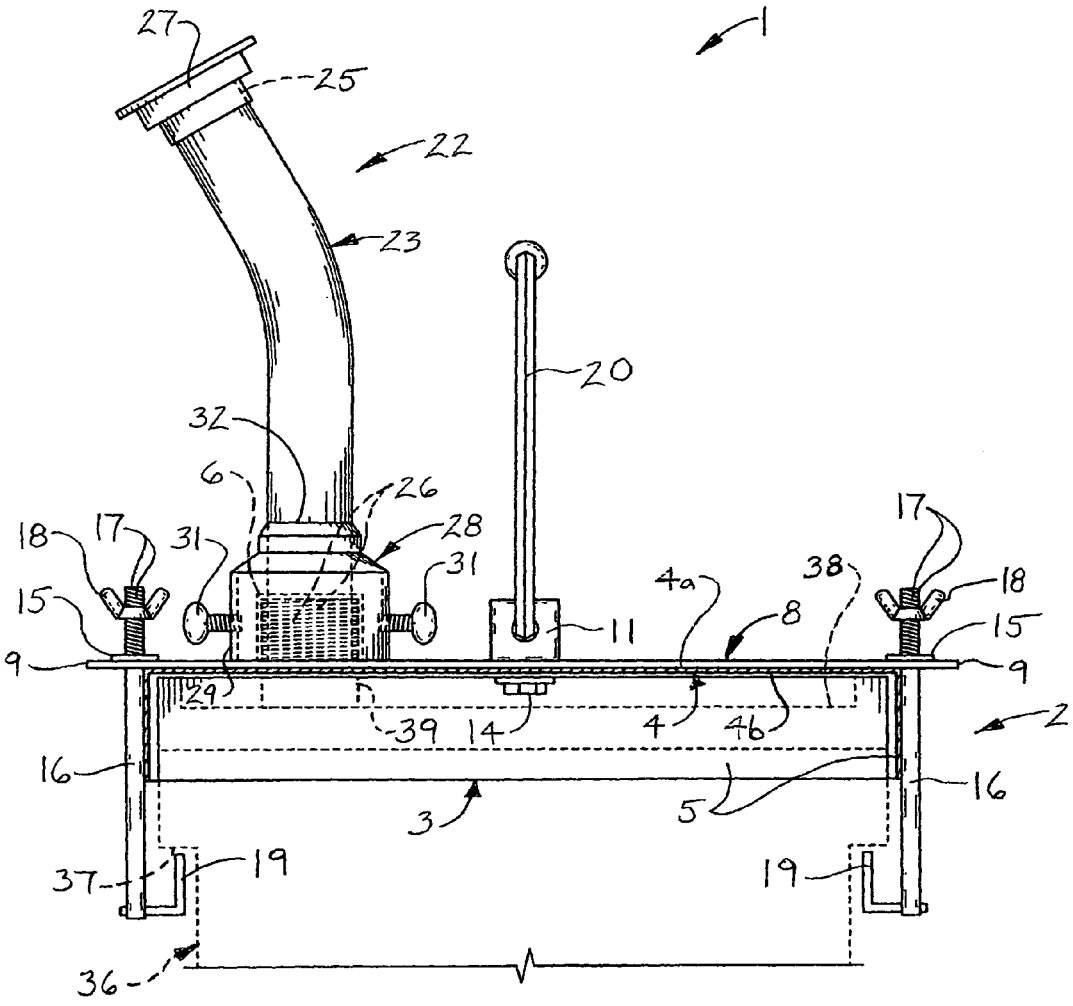
FIG. 7A is a side view of an illustrative embodiment of the dispensing and sealing assembly for container, with the assembly frame illustrated in sectional view and attached to a fluid storage container (illustrated in phantom)
Figure 7B:
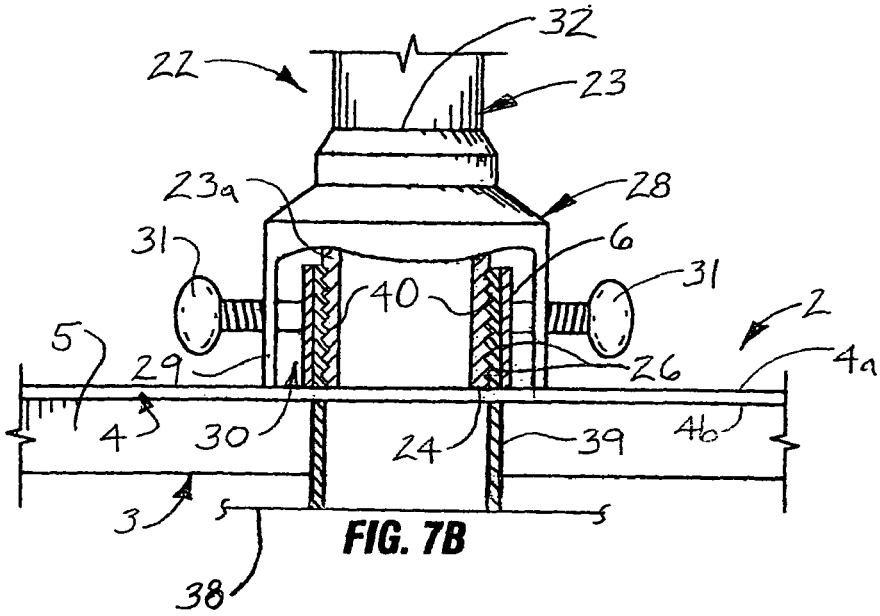
FIG. 7B is a sectional view illustrating an exemplary thread technique for attaching the dispensing assembly to the mounting assembly and to a dispensing spout on a container lid (partially in section) of a fluid dispensing container (not illustrated) in accordance with an illustrative embodiment of the dispensing and sealing assembly for container.

As further illustrated in FIGS. 6 and 7A, the mounting assembly 2 of the assembly 1 may include an assembly frame 3. In some embodiments, the assembly frame 3 may generally have an inverted pan shape, with an assembly frame top 4 which may be circular and may have an upper surface 4*a* and a lower surface 4*b*. An assembly frame side 5 which may be annular may extend from the edge and beyond the lower surface 4*b* of the assembly frame top 4. As illustrated in FIGS. 2 and 3, a nipple opening 7 may extend through the assembly frame top 4 generally between the center and the edge of the assembly frame top 4. An assembly frame nipple 6 which communicates with the nipple opening 7 may extend from the upper surface 4*a* of the assembly frame top 4. In other embodiments, the mounting assembly 2 may have alternative designs which are consistent with the functional requirements of the mounting assembly 2 in the assembly 1.

Figure 1B:
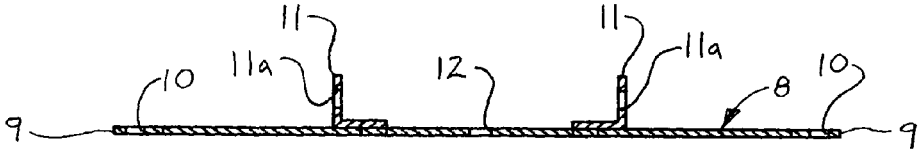
FIG. 1B is a longitudinal sectional view, taken along section lines 1B-1B in FIG. 1A, of the mounting plate.

A mounting plate 8 may be provided on the assembly frame top 4 of the assembly frame 3. As illustrated in FIGS. 1A, 1B and 2, in some embodiments the mounting plate 8 may be generally elongated, with a pair of opposite plate ends 9. The mounting plate 8 may be attached to the assembly frame top 4 of the assembly frame 3 according to any suitable technique which is known by those skilled in the art. In some embodiments, the mounting plate 8 may be attached to the assembly frame top 4 in such a manner that the mounting plate 8 can be manually rotated with respect to the assembly frame 3. Accordingly, a plate attachment bolt opening 12 (FIGS. 1A and 1B) may extend through generally the center of the mounting plate 8. A bolt opening (not illustrated) may extend through generally the center of the assembly frame top 4. A plate attachment bolt 13 (FIG. 3) may extend through the plate attachment bolt opening 12 in the mounting plate 8 and through the registering bolt opening (not illustrated) provided in the underlying assembly frame top 4. Nuts 14 (FIG. 3) may be threaded on the plate attachment bolt 13 to secure the mounting plate 8 on the assembly frame top 4 in such a manner that the mounting plate 8 is capable of being manually rotated on the assembly frame 3 for purposes which will be hereinafter described.

Figure 8:
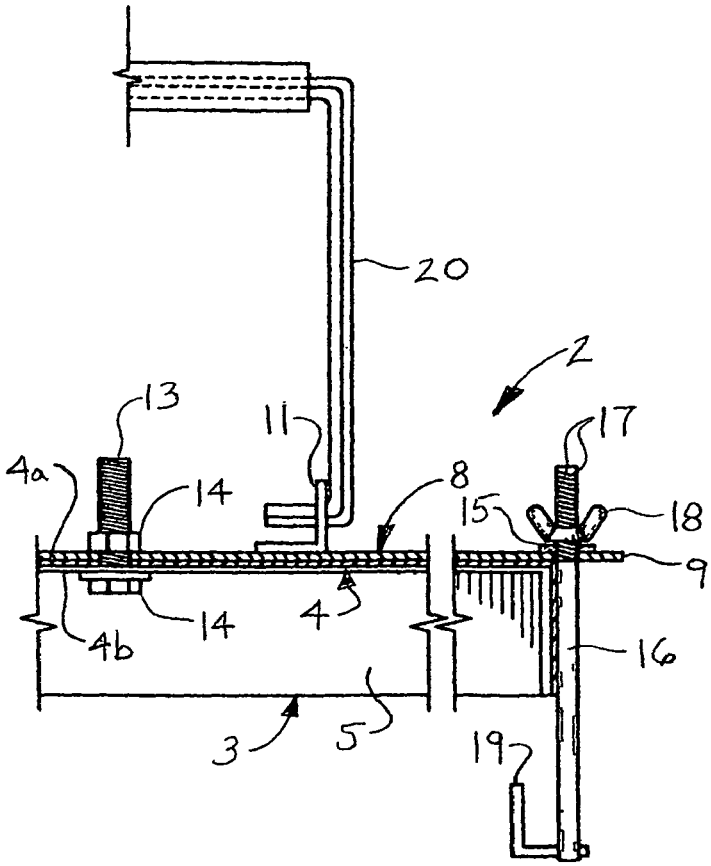
FIG. 8 is a sectional view of a portion of the assembly frame of an illustrative embodiment of the dispensing and sealing assembly for container.

As illustrated in FIGS. 6, 7A and 8, in some embodiments a mounting assembly handle 20 may be attached to the mounting plate 8 of the mounting assembly 2 according to any suitable technique which is known by those skilled in the art. In some embodiments, a pair of spaced-apart handle attachment flanges 11 may be attached to the mounting plate 8 via welding and/or other suitable attachment technique known by those skilled in the art. The mounting assembly handle 20 may be extended through respective handle openings 11*a* (FIG. 1B) provided in the respective handle attachment flanges 11. In other embodiments, alternative techniques known to those skilled in the art may be used to attach the mounting assembly handle 20 to the mounting plate 8.

The assembly frame 3 and the mounting plate 8 of the mounting assembly 2 may be attached to the container 36 according to any suitable technique which is known by those skilled in the art. As illustrated in FIGS. 6, 7A and 8, in some embodiments a pair of spaced-apart assembly bolts 16 may extend downwardly from the mounting plate 8 of the mounting assembly 2. The assembly bolts 16 may be attached to the mounting plate 8 according to any suitable technique which is known by those skilled in the art. In some embodiments, a pair of assembly bolt openings 10 (FIGS. 1-2) may extend through the mounting plate 8 generally at or adjacent to the respective plate ends 9. Each assembly bolt 16 may be extended through each corresponding assembly bolt opening 10. Each assembly bolt 16 may extend generally adjacent to and outside of the assembly frame side 5 of the assembly frame 3. In some embodiments, assembly bolt threads 17 may be provided on the upper end portion of each assembly bolt 16. A wing nut 18 may be threaded on the assembly bolt threads 17. A washer 15 may be provided on each assembly bolt 16 and interposed between the wing nut 18 and the mounting plate 8. An assembly mount flange 19 may be provided on the lower end of each assembly bolt 16. Accordingly, in attachment of the mounting assembly 2 to the container 36, as illustrated in FIG. 7A and will be hereinafter further described, the assembly mount flanges 19 provided on the respective assembly bolts 16 may be inserted into the annular circumferential container groove 37 which is provided in the exterior surface of the container 36 beneath the container lid 38. The wing nuts 18 are threaded on the assembly bolt threads 17 against the respective washers 15 to raise the assembly bolts 16 through the respective assembly bolt openings 10 and cause the rising assembly mount flanges 19 to engage the container 36 in the upper portion of the container groove 17 and secure the assembly frame 3 and the mounting plate 8 of the mounting assembly 2 to the container 36. In other embodiments, alternative techniques which are known by those skilled in the art may be used to attach the assembly frame 3 and the mounting plate 8 of the mounting assembly 2 to the container 36.

Figure 4:
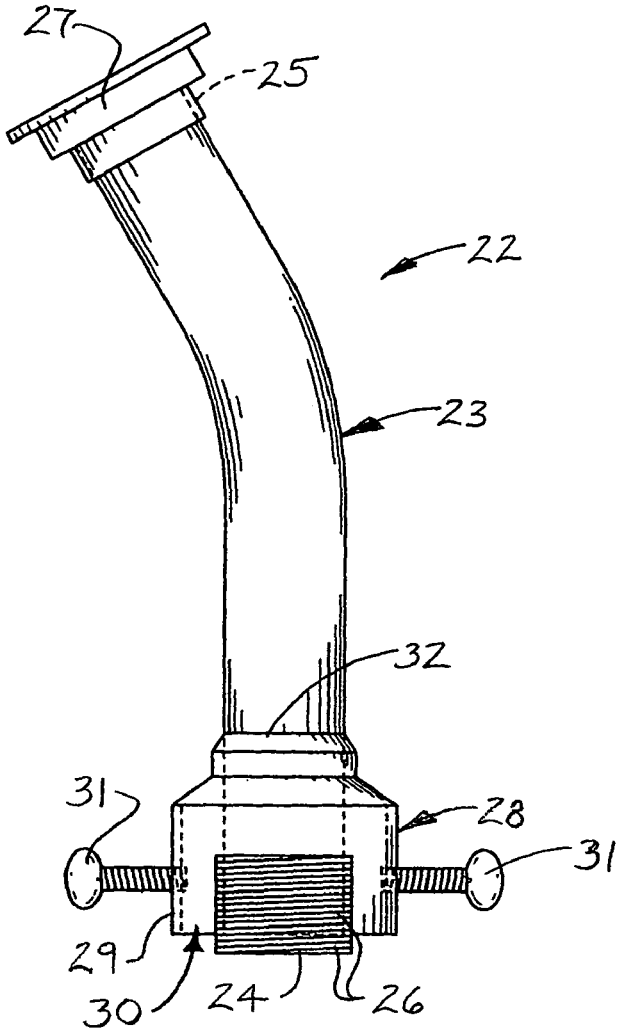
FIG. 4 is a side view of a dispensing assembly of an illustrative embodiment of the dispensing and sealing assembly for container.
Figure 5:
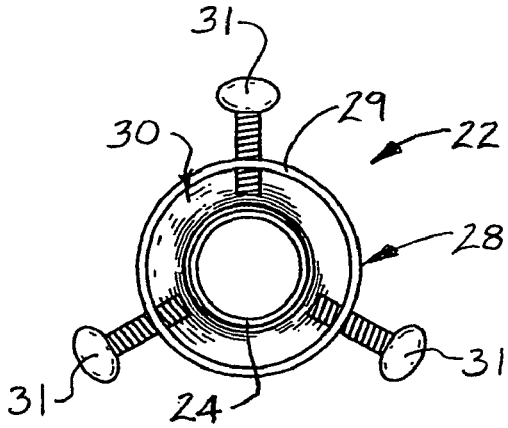
FIG. 5 is a bottom view of the dispensing assembly.

As further illustrated in FIGS. 6 and 7A, the dispensing assembly 22 is adapted for attachment to the mounting assembly 2 such as in a manner which will be hereinafter described. As illustrated in FIGS. 4 and 5, in some embodiments the dispensing assembly 22 may include a generally elongated dispensing assembly tube 23 having a tube wall 23*a* (FIG. 7B) which may be a rigid or flexible plastic or metal, for example and without limitation. As illustrated in FIG. 4, the dispensing assembly tube 23 may have a generally curved shape. The dispensing assembly tube 23 may have an attachment end 24 and a dispensing end 25 which is opposite the attachment end 24. Attachment threads 26 may be provided generally at the attachment end 24 of the dispensing assembly tube 23. In some embodiments, the attachment threads 26 may be provided on the exterior surface of the tube wall 23*a* of the dispensing assembly tube 23, as illustrated. In other embodiments, the attachment threads 26 may be provided on the interior surface of the tube wall 23*a*. A tube cap 27 may be detachably provided on the dispensing end 25 of the dispensing assembly tube 23 to selectively provide a fluid-tight seal with the dispensing assembly tube 23. In some embodiments, the tube cap 27 may be threadibly attached to the dispensing end 25 of the dispensing assembly tube 23. In other embodiments, the tube cap 27 may be attached to the dispensing assembly tube 23 via a friction fit or other technique.

A tube skirt 28 (illustrated partially in section in FIG. 7B) may be provided generally at the attachment end 24 of the dispensing assembly tube 23. The tube skirt 28 may include a skirt wall 29 having a tube opening 32 through which the dispensing assembly tube 23 extends. In some embodiments, the dispensing assembly tube 23 may freely extend through the tube opening 32 such that the position of the tube skirt 28 along the dispensing assembly tube 23 can be selectively varied. From the tube opening 32, the tube skirt 28 may generally flare outwardly to define a skirt interior 30. The attachment threads 26 of the dispensing assembly tube 23 may form an annulus with the interior surface of the skirt wall 29 in the skirt interior 30 of the tube skirt 28. In some embodiments, multiple thumb screws 31 may be threaded through respective thumb screw openings (not illustrated) provided in the skirt wall 29 of the tube skirt 28 for purposes which will be hereinafter described.

As illustrated in FIG. 7A, in an exemplary application of the apparatus 1, the mounting assembly 2 is attached to the container 36 which in some applications may be used to store a supply of fluid (not illustrated) such as a commercially-available industrial lubricant, for example and without limitation, which can be poured from the container 1. The container 36 and container lid 38 may be a conventional 5-gallon lubricant storage container which is commonly used to store industrial lubricants and the like. In other applications, the container 36 may be used to store solid powdered, particulate or granulated contents (not illustrated) which can be poured from the container 36. Accordingly, the container lid 38 is initially placed on the container 36 in the normal manner to seal the contents of the container 36. The mounting assembly 2 of the apparatus 1 is then attached to the container 36 by initially placing the assembly frame 3 of the mounting assembly 2 over the container lid 38 such that the lower surface 4*b* of the assembly frame top 4 of the assembly frame 3 is lowered to rest on the container lid 38 as the assembly frame side 5 of the assembly frame 3 receives and generally encircles or surrounds the container lid 38. The assembly bolts 16 extend adjacent to and outside of the assembly frame 3, with the assembly mount flanges 19 located in the container groove 37 of the container 36. As the assembly frame 3 is lowered in place onto the container lid 38, the dispensing spout 39 of the container lid 38 extends through the nipple opening 7 and the assembly frame nipple 6 (FIG. 3) of the assembly frame 3. The wing nuts 18 may be threaded on the assembly bolt threads 17 of the respective assembly bolts 16 and rotated against the respective washers 15 to incrementally raise the assembly bolts 16 through the respective assembly bolt openings 10 (FIGS. 1A, 1B and 2) provided in the mounting plate 8. This action causes engagement of the assembly mount flanges 19 on the respective assembly bolts 16 with the upper portion of the container groove 37 until the assembly frame 3 of the mounting assembly 2 is firmly seated on the container lid 38.

In some embodiments, the container 36 may be fitted with a bail or handle (not illustrated) which extends across the diameter of the container 36. Therefore, the positions of the assembly bolts 16 relative to the bail can be selectively adjusted, as deemed necessary, by rotating the mounting plate 8 on the container lid 38.

After the mounting assembly 2 is seated on the container lid 38 typically as was heretofore described, the dispensing assembly 22 is attached to the mounting assembly 2. Accordingly, the conventional spout cap (not illustrated) may initially be removed from the dispensing spout 39 of the container lid 38. As particularly illustrated in FIG. 7B, the dispensing assembly 22 may then be attached to the mounting assembly 2 by causing engagement of the attachment threads 26 provided on the tube wall 23*a* at the attachment end 24 of the dispensing assembly tube 23 with the companion spout threads 40 provided on the dispensing spout 39 of the container lid 38. In some embodiments, exterior attachment threads 26 provided on the assembly tube 23 may engage interior spout threads 40 provided in the dispensing spout 39, as illustrated. In other embodiments, interior attachment threads 26 provided in the assembly tube 23 may engage exterior spout threads 40 provided on the dispensing spout 39. Therefore, a fluid-tight seal is formed between the dispensing assembly tube 23 and the dispensing spout 39 of the container lid 38. The tube skirt 28 is then slid over the dispensing assembly tube 23 and lowered to rest on the upper surface 4*a* of the assembly frame top 4, with the tube skirt 28 deployed generally over the nipple opening 7 (FIGS. 2 and 3). The thumb screws 31 may be threaded and tightened against the assembly frame nipple 6 of the assembly frame 3 to secure the tube skirt 28 in place on the assembly frame 3.

For storage of the contents (not illustrated) in the container 36, the tube cap 27 may be fitted in place on the dispensing end 25 of the dispensing assembly tube 23 to seal the interior of the container 36 from moisture, dirt and other impurities. In some embodiments, the tube cap 27 may be threadibly attached to the dispensing end 25 of the dispensing assembly tube 23. In other embodiments, the tube cap 27 may be attached to the dispensing assembly tube 23 via a friction fit or other technique. The container 36 can be selectively carried by grasping of the mounting assembly handle 20.

The container contents (not illustrated) may be selectively dispensed from the container 36 by initially removing the tube cap 27 from the dispensing end 25 of the dispensing assembly tube 23 and pouring the contents from the container 36 through the dispensing spout 39 of the container lid 38 and discharging the contents from the uncapped dispensing end 25 of the dispensing assembly tube 23, respectively, by gravity. The tube cap 27 can be selectively replaced on the dispensing end 25 of the dispensing assembly tube 23 to facilitate sealed storage of the fluid contents of the container 36. The assembly 1 can be selectively detached and removed from the container 36 and container lid 38 by unthreading the wing nuts 18 on the assembly bolt threads 17 of the respective assembly bolts 16 to cause disengagement of the assembly mount flanges 19 from the container groove 37, followed by lifting of the mounting assembly 2 from the container lid 38.

It will be appreciated by those skilled in the art that the apparatus 1 may be attached to the container lid 38 without having to first remove the container lid 38 from the container 36. Furthermore, the apparatus 1 may be readily attached to the container lid 38 of an conventional 5-gallon container 36 which is of the type commonly used to store industrial lubricants and the like.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A dispensing and sealing assembly for a container having a container lid detachably fitted on the container, a dispensing spout extending from the container lid and a container groove in the container beneath the container lid, the dispensing and sealing assembly comprising:

a mounting assembly adapted for detachable engagement with the container and comprising:

a generally inverted pan-shaped assembly frame having an assembly frame top, an assembly frame side extending from said assembly frame top and an opening extending through said assembly frame top;

a mounting plate carried by said assembly frame top of said assembly frame, said mounting plate rotatable with respect to said assembly frame; and a plurality of assembly mount flanges carried by said mounting plate and adapted to detachably engage the container groove in the container; and a dispensing assembly carried by said mounting assembly and comprising:

a tube skirt carried by said assembly frame top of said assembly frame generally over said opening; and a dispensing assembly tube extending from said tube skirt and having a plurality of attachment threads, the dispensing assembly tube adapted for placement in fluid communication with the dispensing spout on the container lid of the container when the mounting assembly detachably engages the container.

2. The dispensing and sealing assembly of claim 1 further comprising an assembly frame nipple extending from said assembly frame top in communication with said opening, and wherein said tube skirt of said dispensing assembly receives said assembly frame nipple.

3. The dispensing and sealing assembly of claim 2 further, comprising a plurality of thumb screws carried by said tube skirt and engaging said assembly frame nipple.

4. The dispensing and sealing assembly of claim 2 wherein said attachment threads of said dispensing assembly tube are disposed in said assembly frame nipple.

5. The dispensing and sealing assembly of claim 1 further comprising a plurality of assembly bolts carried by said mounting plate of said mounting assembly and wherein said plurality of assembly mount flanges is carried by said plurality of assembly bolts, respectively.

6. The dispensing and sealing assembly of claim 1 wherein said tube skirt comprises a flared skirt wall having a tube opening and a skirt interior communicating with said tube opening, and wherein said dispensing assembly tube extends through said tube opening.

7. The dispensing and sealing assembly of claim 1 further comprising a mounting assembly handle carried by said mounting plate.

8. A dispensing and sealing assembly, comprising:

a container lid having a dispensing spout with spout threads;

a mounting assembly comprising:

an assembly frame carried by said container lid and having an opening receiving said dispensing spout of said container lid; and a plurality of assembly mount flanges carried by said assembly frame; and a dispensing assembly carried by said mounting assembly and comprising:

a tube skirt having a tube skirt interior carried by said assembly frame generally over said opening and receiving said dispensing spout; and a dispensing assembly tube extending from said tube skirt and having attachment threads engaging said spout threads of said dispensing spout in said tube skirt interior;

wherein said spout threads comprises interior spout threads provided on an interior surface of said dispensing spout and said attachment threads comprises exterior attachment threads provided on an exterior surface of said dispensing assembly tube and engaging said spout threads; and wherein said assembly frame comprises an assembly frame top carried by said container lid and an assembly frame side extending from said assembly frame top, and wherein said opening extends through said assembly frame top and further comprising an assembly frame nipple extending from said assembly frame top in communication with said opening, and wherein said tube skirt of said dispensing assembly receives said assembly frame nipple.

9. The dispensing and sealing assembly of claim 8 further comprising a mounting plate carried by said assembly frame top of said assembly frame and a plurality of assembly bolts carried by said mounting plate, and wherein said plurality of assembly mount flanges is carried by said plurality of assembly bolts, respectively.

* * * * *